US006080025A

United States Patent [19]

Isogawa et al.

[11] Patent Number: 6,080,025

[45] Date of Patent: Jun. 27, 2000

[54] COWLING LATCH FOR OUTBOARD MOTOR

[75] Inventors: Atsushi Isogawa; Takaji Kawai, both of Hamamatsu, Japan

[73] Assignee: Sanshin Kogyo Kabushiki Kaisha, Japan

[21] Appl. No.: 09/099,263

[22] Filed: Jun. 18, 1998

[30] Foreign Application Priority Data

Jun. 19, 1997 [JP] Japan ..... 9-177791

[51] Int. Cl.[7] ..... B63H 20/32

[52] U.S. Cl. ..... 440/77; 123/196 R

[58] Field of Search ..... 440/88, 77, 900; 123/196 R

[56] References Cited

U.S. PATENT DOCUMENTS 5,046,976 9/1991 Kobayashi et al. ..... 440/77

5,803,777 9/1998 Hiraoka ..... 440/77

*Primary Examiner*—Jesus D. Sotelo

*Attorney, Agent, or Firm*—Knobbe, Martens, Olson & Bear, LLP

[57] ABSTRACT

A cowling latch for an outboard motor having an upper cowling having a lower surface and a lower cowling having an upper surface is disclosed. The cowling latch comprises a first latching member connected to the upper cowling and a second latching member connected to the lower cowling. The second latching member is moveable between a first position in which it engages the first latching member for connecting the upper and lower cowlings and a second position in which it does not engage the first latching member. The second latching member comprises a first latching member engaging part movably mounted with respect to a support, the support positioned below the upper surface of the lower cowling.

21 Claims, 5 Drawing Sheets

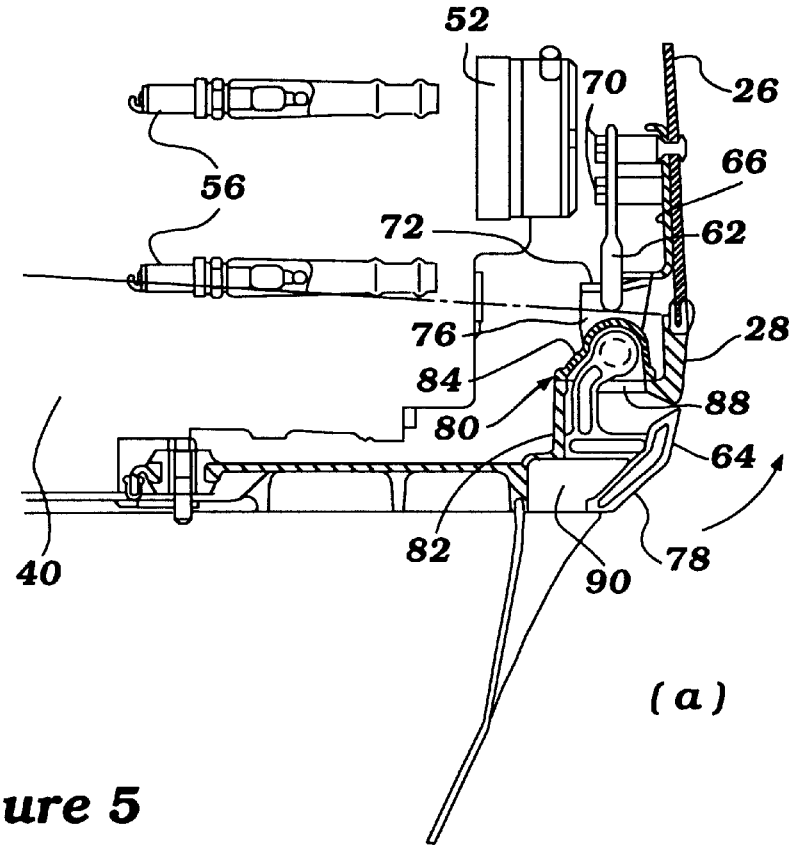
Figure 5
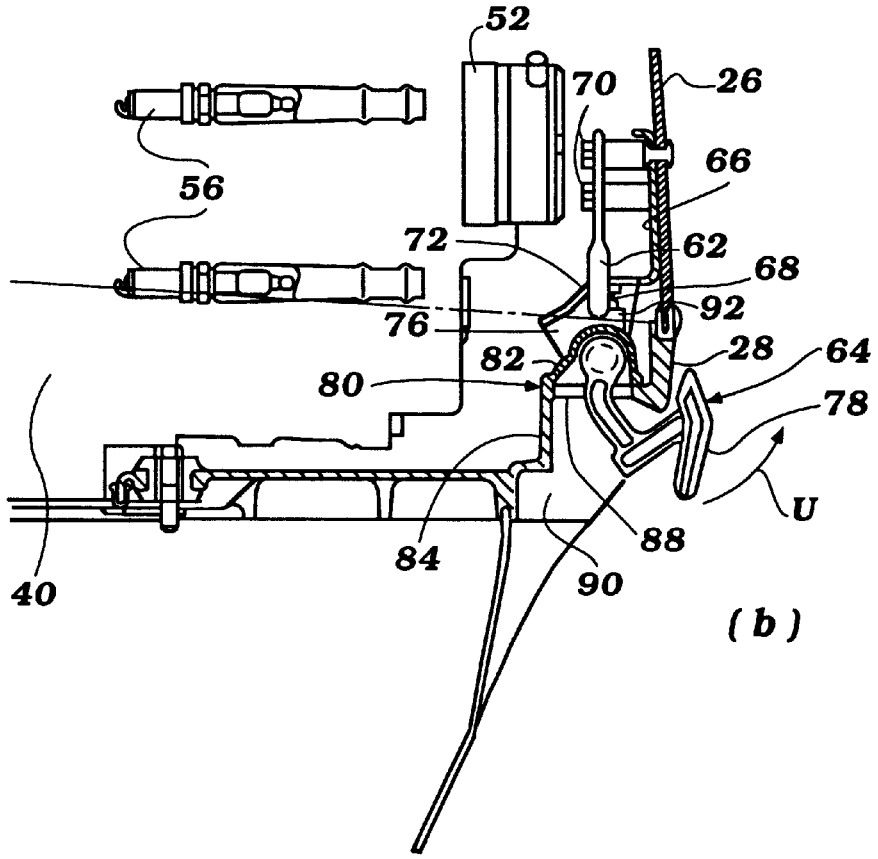

COWLING LATCH FOR OUTBOARD MOTOR

FIELD OF THE INVENTION

The present invention relates to a cowling of an outboard motor. More particularly, the invention is a latch for selectively connecting two portions of such a cowling.

BACKGROUND OF THE INVENTION

Watercraft are often powered by outboard motors positioned at the stem of the craft. These motors have an internal combustion engine positioned within a cowling of the motor.

The cowling normally has one or more portions which may be removed so as to provide access to the engine therein. One problem with this arrangement is that the removeable portion(s) of the cowling must be easily removeable, and at the same time be securely re-connectable. If the portions of the cowling do not connect to one another in secure fashion, water and other debris may enter the compartment therein and be introduced into the engine. On the other hand, if the removeable portions of the cowling are not easily disconnected, the cost and time for servicing the engine is high.

Another problem is that in many instances, parts of the engine are still relatively inaccessible even when the removeable portion of the cowling is removed. So arranged, the ability of the owner of the motor to service the motor may be severely limited, and the cost of servicing the motor even by a professional technician is likely to be high.

An improved cowling arrangement for an outboard motor which includes a cowling latch for selectively connecting and disconnecting portions of the cowling is desirable.

SUMMARY OF THE INVENTION

The present invention is a cowling latch for an outboard motor. The outboard motor is of the type having an upper cowling having a lower surface and a lower cowling having an upper surface.

The cowling latch comprises a first latching member connected to the upper cowling and a second latching member connected to the lower cowling. The second latching member is moveable between a first position in which it engages the first latching member for connecting the upper and lower cowlings and a second position in which it does not engage the first latching member. The second latching member comprises a first latching member engaging part movably mounted with respect to a support, the support positioned below the upper surface of the lower cowling.

In a preferred embodiment, the first latching member comprises a hook and the second latching member comprises a clamp including a hook-engaging member which is mounted to a shaft which is rotatable between a first position in which it engages the hook and a second position in which it does not. The shaft rotates about an axis which is below the upper surface of the lower cowling in a passage defined by the support.

Further objects, features, and advantages of the present invention over the prior art will become apparent from the detailed description of the drawings which follows, when considered with the attached figures.

BRIEF DESCRIPTION OF THE DRAWINGS

FIG. 3(*b*) illustrates the cowling latch illustrated in FIG. 3(*a*);

FIG. 5(*a*) is a partial cross-sectional side view of the outboard motor illustrated in FIG. 1, illustrating the cowling latch in a latched position; and FIG. 5(*b*) illustrates the cowling latch illustrated in FIG. 5(*b*) in an unlatched position.

DETAILED DESCRIPTION OF THE PREFERRED EMBODIMENTS OF THE INVENTION

The present invention is a latch 20 for selectively connecting at least two members. The latch 20 is preferably used to selectively connect two portions of a cowling of an outboard motor 22.

Figure 1:
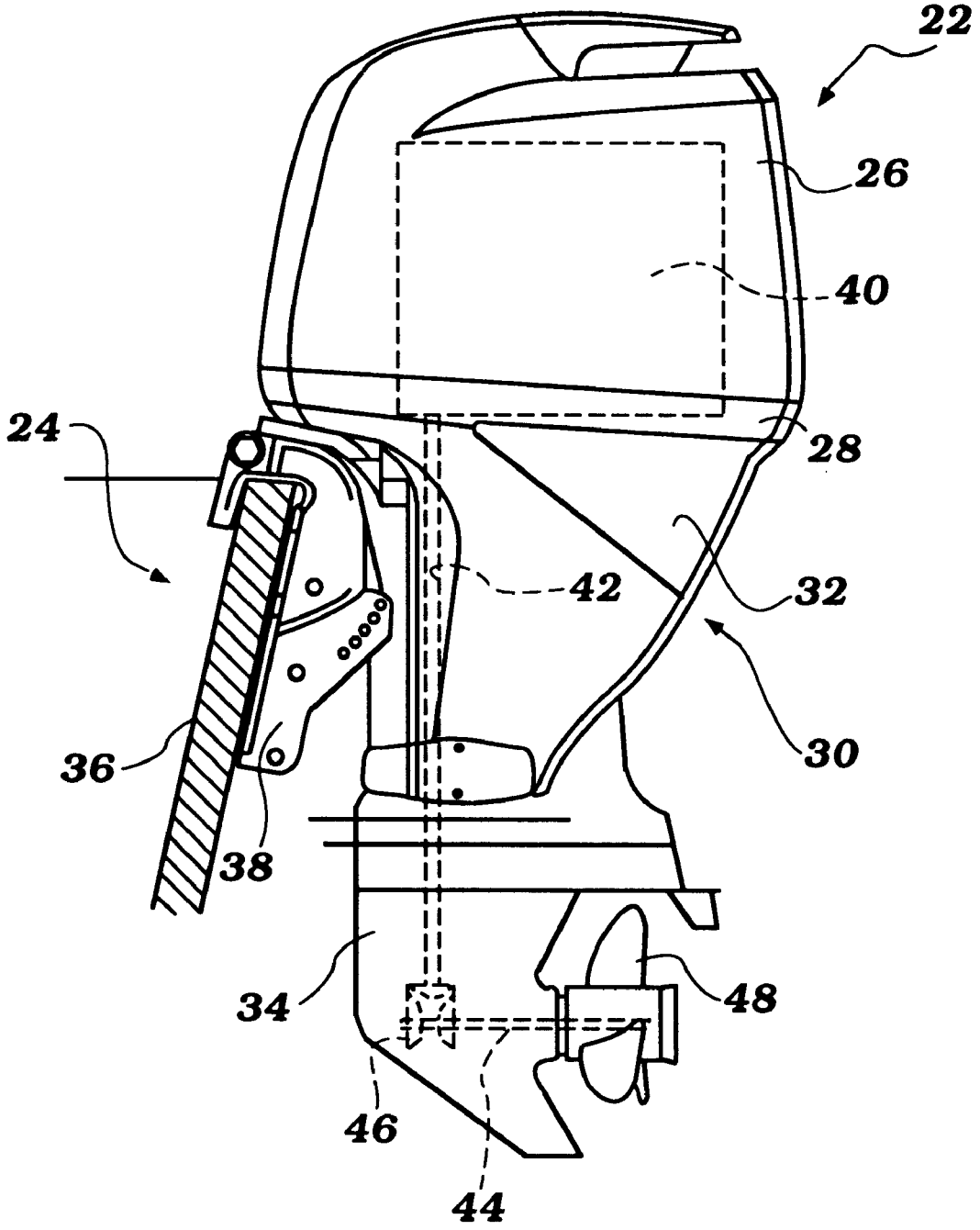
FIG. 1 is a side view of an outboard motor having a cowling with a cowling latch in accordance with the present invention.

FIG. 1 generally illustrates an outboard motor 22 of the type with which the latch 20 of the present invention is particularly useful. Those of skill in the art will appreciate that the latch 20 may be used in conjunction with an outboard motor 22 which differs in configuration from that illustrated and described. The latch 20 may also have utilizing in a variety of other settings.

The outboard motor 22 is of the type utilized to power a watercraft 24. The outboard motor 20 has an engine enclosure or compartment defined by an upper cowling 26 and a lower cowling 28. A lower unit 30 extends below the lower cowling 28. The lower unit 30 comprises an upper or "drive shaft housing" section 32 and a lower section 34.

The outboard motor 22 is connected to a transom 36 of the watercraft 24 by a mounting bracket 38. Preferably, the motor 22 movably connected to the bracket 38 about both a vertical axis and a horizontal axis. This arrangement permits the motor 22 to be turned for steering the watercraft 24 and permits the motor 22 to be raised and lowered or "trimmed." This type of mounting arrangement is well known to those of skill in the art.

An engine 40 is positioned within the enclosure defined by the upper and lower cowlings 26,28. The engine 40 is preferably of the internal combustion type and may have a wide variety of configurations, such as in-line (as shown), "V" or the like. The engine 40 may be of the reciprocating piston or rotary or other type, and may operate on a two or four cycle operating principle. As illustrated, the engine 40 is of the in-line reciprocating piston type, having four cylinders vertically arranged. Each cylinder has a combustion chamber portion.

The engine 40 powers an output shaft which, as also illustrated in FIG. 1, is arranged to drive a drive shaft 42. The drive shaft 42 is vertically extending, having its upper end coupled to the output shaft of the engine 40 and its lower end selectively driving a propeller shaft 44 through a transmission 46. The transmission 46 is preferably of a conventional forward-neutral-reverse type well known in the art.

A propeller 48 is connected to the propeller shaft 44 and is driven thereby when the transmission 46 engages the drive shaft 42. Those of skill in the art will appreciate that the engine 40 may be arranged to drive a water propulsion device other than a propeller associated with the motor 22.

Certain features of the engine 40 will be described in greater detail with reference to FIGS. 2–4. Air and fuel are supplied to the combustion chambers of the engine 40. The air is supplied through a suitable air intake system. As illustrated, this intake system includes an air intake box or silencer 50 through which air from within the engine compartment is drawn. The air is delivered to each combustion chamber from the silencer 50 by intake pipes 51 and passages, as well known to those of skill in the-art.

Fuel is supplied to the engine 40 from a fuel supply, such as a fuel tank positioned in the watercraft 24. As illustrated, a pair of fuel pumps 52 draw the fuel from the supply and deliver it to the engine 40. A vapor separator 54 is provided along the fuel path for separating fuel and air vapor from the fuel. This fuel includes a charge forming mechanism such as one or more fuel injectors or carburetors which deliver the fuel directly into the combustion chambers or to the air which is being delivered thereto, as well known to those of skill in the art.

The fuel and air charge in each combustion chamber is ignited with a spark plug 56 or similar ignition device. An ignition system (not shown) is associated with the spark plugs 56 for providing a timed spark. The ignition system may include an electrical box. When the engine 40 is arranged as described above, the spark plugs 56 are also vertically arranged, and the electrical box may be positioned on the engine 40 at or near the same height as the lowest spark plug 56.

Exhaust which is generated by the engine 40 is routed through an appropriate exhaust system to a point external to the motor 20. Such an exhaust system may include a through the propeller hub discharge, as well known to those of skill in the art.

The engine 40 as illustrated includes first and second gears 58 which drive an intake and exhaust camshaft, respectively. These camshafts are arranged to operate intake and exhaust valves which control the flow of air into each combustion chamber and the flow of exhaust therefrom. The gears 58 are preferably driven by the crank or output shaft of the engine 40 by an appropriate drive mechanism (not shown).

The engine 40 preferably includes a lubricating and cooling system. These systems are well known to those of skill in the art, and as such do not form a portion of the invention herein, are not illustrated.

Figure 2:
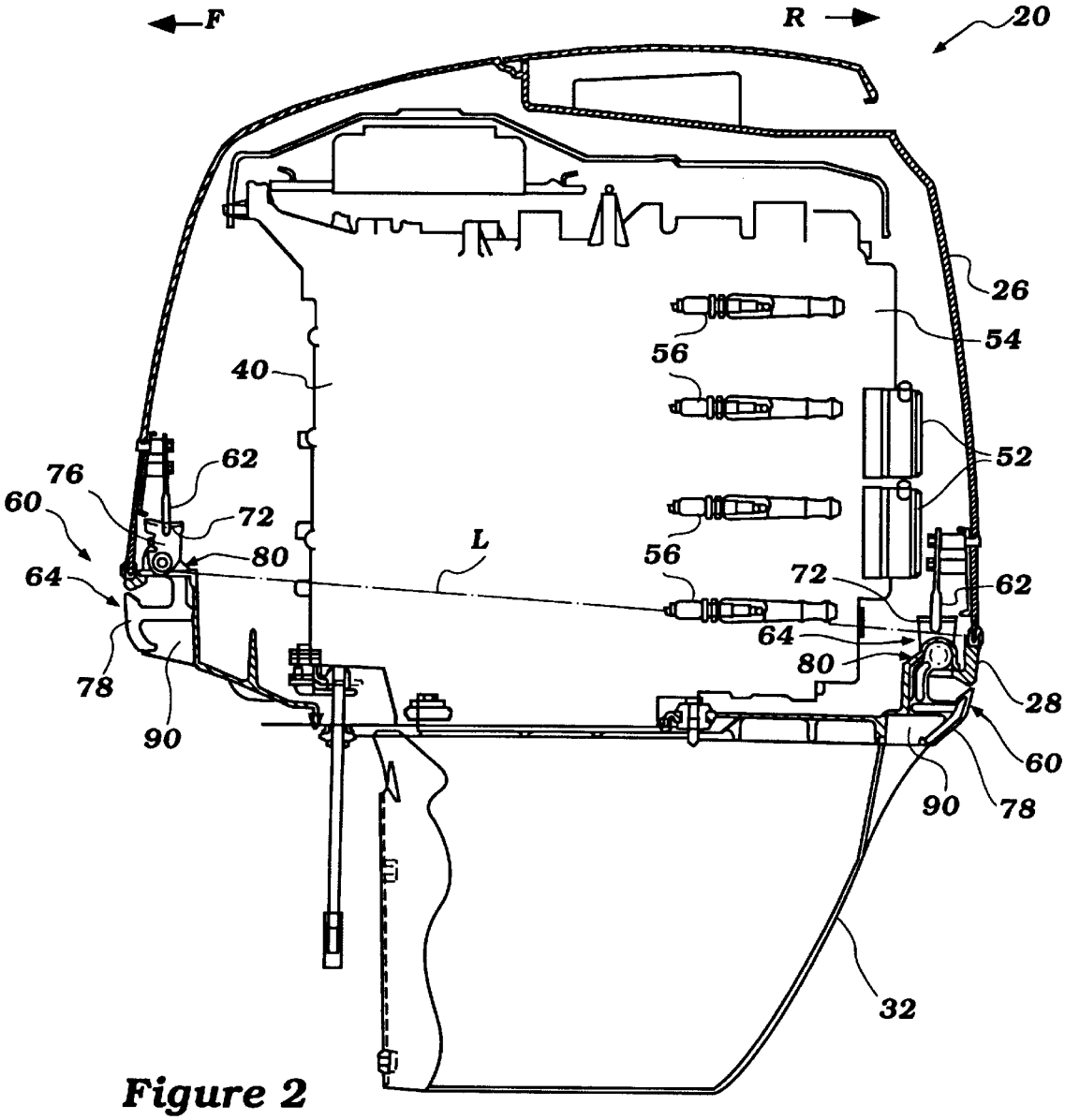
FIG. 2 is a partial cross-sectional side view of the outboard motor illustrated in FIG. 1.
Figure 3:
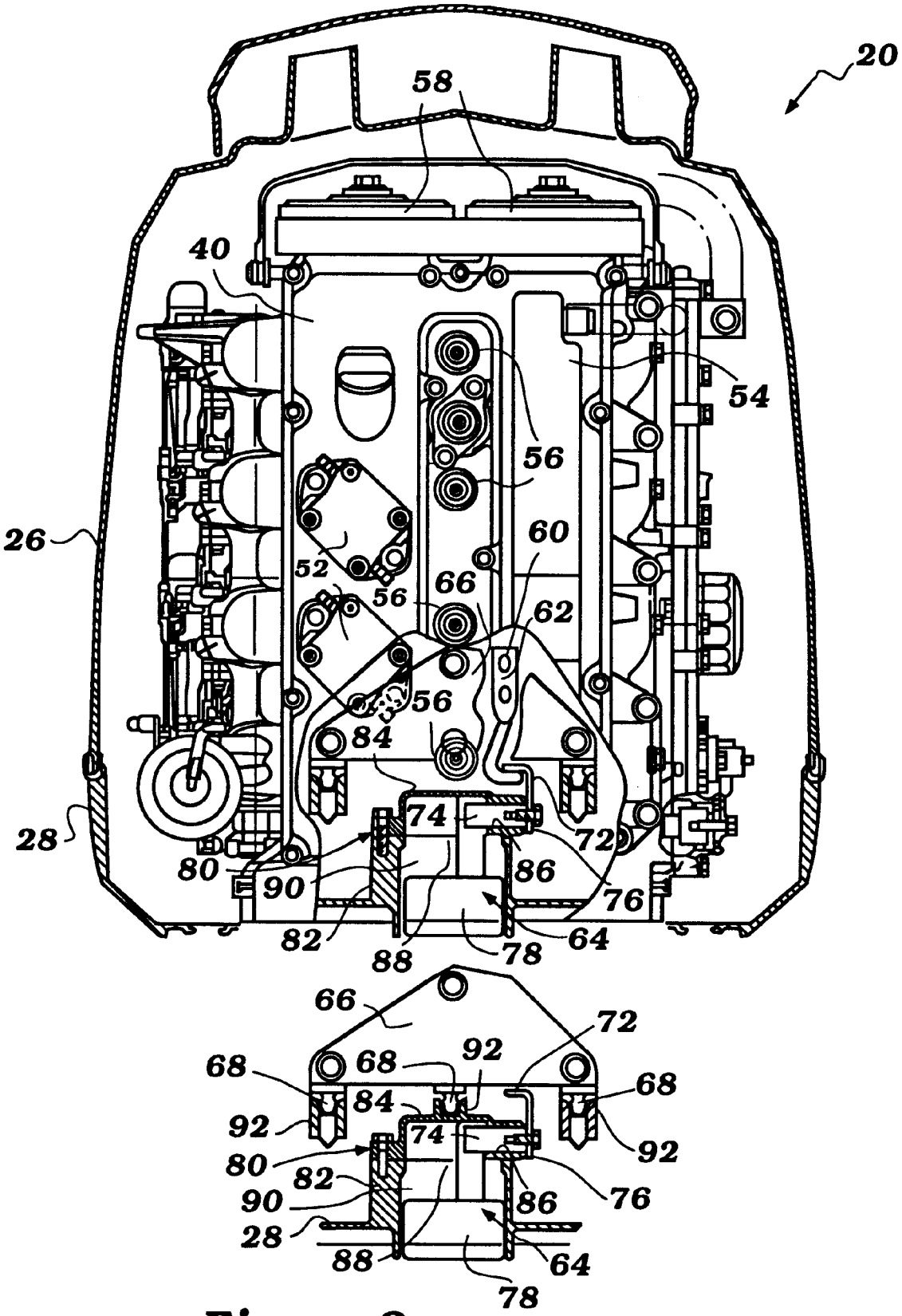
FIG. 3(*a*) is cross-sectional end view of the outboard motor illustrated in FIG. 1, with the cowling latch thereof illustrated superimposed over an engine in the cowling.

Referring to FIG. 2, the lower cowling 28 is arranged so that its top or highest surface, defined by an upper edge, is below the lowest spark plug 56. In this figure, the dotted line L illustrates the highest level of the lower cowling 28 between the front and rear ends of the motor 20. The lowest spark plug 56 is positioned generally at or above this line L.

The upper cowling 26 has a lower edge or bottom end which engages the top or upper end or edge of the lower cowling 28. When engaged, the upper and lower cowlings 26,28 form the engine enclosure. Preferably, however, the upper cowling 26 is selectively removeable from the lower cowling 28, permitting access to the engine 40 and its components.

In accordance with the present invention, means are provided for selectively connecting the upper and lower cowlings 26,28. This means preferably comprises a cowling latch in the form of at least one latching mechanism 60.

Figure 4:
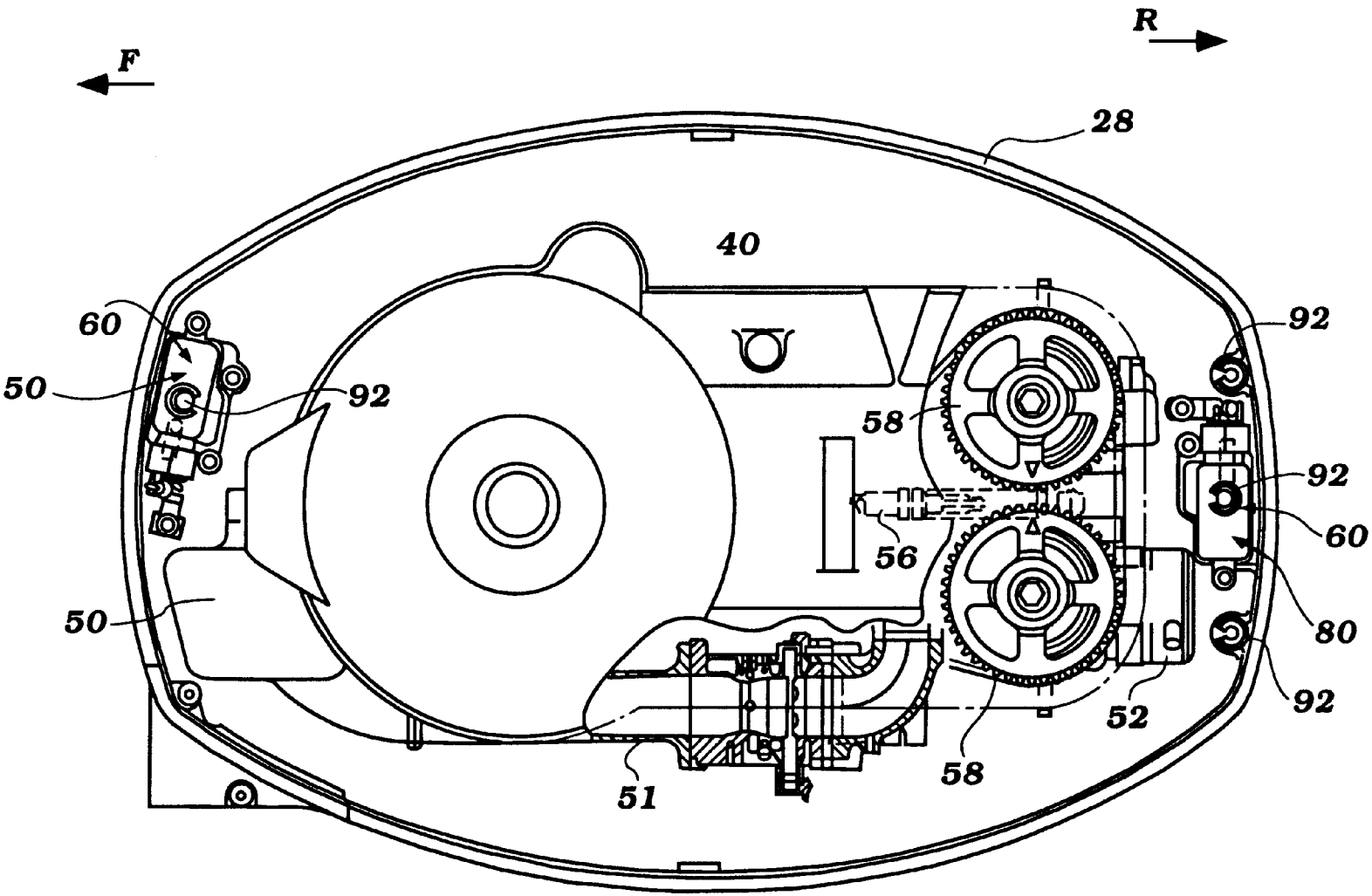
FIG. 4 is a cross-sectional top view of the outboard motor illustrated in FIG. 1.

Referring to FIGS. 2 and 4, a latching mechanism 60 is provided at the front F and rear R of the motor 20. These latching mechanisms 60 will be described primarily with reference to FIGS. 3(*a*) and (*b*) and 5(*a*) and (*b*).

The latching mechanism 60 includes a first latching member which is connected to the upper cowling 26, and a second latching member which is connected to the lower cowling 28 and arranged for selective engagement with the first latching member. The first latching member preferably comprises a hook 62, while the second latching member preferably comprises a rotating clamp 64.

A damper plate 66 is connected to the inside of the upper cowling 26, such as with bolts, rivets or other fastening means. The hook 62 is connected to the damper plate 66 with a pair of bolts 70 or other fasteners.

The hook 62 has a free end which extends downwardly to a point generally flush with the lower edge of the upper cowling 26. The free end of the hook 62 defines a generally horizontally extending engaging surface.

The clamp 64 comprises a hook-engaging member 72 connected to a shaft 74 with a mounting part 76, the shaft 74 in turn connected to a handle 78. The shaft 74 is rotatably mounted in a support 80 about a generally horizontal axis.

The support 80 comprises a base 82 which is formed as a portion of the lower cowling 28, and a cover 84 which is connected to the base 82. The cover 84 and base 82 cooperate to define a shaft support passage 86 in which is rotatably mounted the shaft 74.

A first end of the shaft 74 extends from the support 80. The mounting part 76 is connected to this end of the shaft 74 with a screw (as illustrated), bolt or by other means such as welding. As illustrated, the mounting part 76 and hook-engaging member 74 are integrally formed, and generally "L"-shaped.

A second end of the shaft 74 is positioned with a space 88 defined inside the support 80. The handle 78 is connected to this end of the shaft 74, and extends downwardly into a recessed area 90 of the lower cowling 28. So positioned, the handle 78

As illustrated, a seal is provided at the interface between the lower edge of the upper cowling 26 and the upper edge of the lower cowling 26 for keeping water and other material out of the engine compartment.

FIG. 5(*b*) illustrates the clamp 64 in its second or "unlatched" position. A user of the motor 20 may grasp the handle 78 and rotate it in the direction of arrow U. As the handle 78 rotates, the shaft 74 to which it is connected rotates as well, as does the connected hook-engaging member 72. The hook-engaging member 72 rotates out of engagement with the hook 66. The upper cowling 26 may then be removed from the lower cowling 28.

While the description of the operation of the latching member 60 has been made with reference to the rear latching member (as illustrated in FIGS. 5(*a*) and (*b*)), the description applies equally to the latching member 60 positioned at the front of the motor 20.

Advantageously, and in accordance with the present invention, the axis about which the shaft 74 rotates is positioned below the line L. In this manner, when the upper cowling 26 is removed from the lower cowling 28, the latching mechanism 60 does not generally interfere with the removal and replacement of the lowest spark plug 56. Preferably, the entire support 80 is positioned below this line L, as best illustrated in FIGS. 5(*a*) and (*b*).

Those of skill in the art will appreciate that other latching mechanisms 60 than that described above may be used to connect the upper and lower cowlings 26,28. For example, the clamp 64 may be arranged to engage a member other than a hook 62, such as a projection of the damper plate 66 or the like.

The clamp 64 could also be arranged to translate vertically and horizontally to engage and disengage the hook 62, could rotate about a vertical axis or the like, as known to those of skill in the art, as long as the moving member and/or its support is positioned below the upper edge or surface of the lower cowling 28 for the reasons stated above. In this regard, it is noted that the first latching member connected to the upper cowling 26 may extend below the lower edge or surface thereof. This may be undesirable in at least some arrangements since when the upper cowling 26 is removed and set on a surface such as the ground, the first latching member might be damaged.

Of course, the foregoing description is that of preferred embodiments of the invention, and various changes and modifications may be made without departing from the spirit and scope of the invention, as defined by the appended claims. has a user-engaging portion which is positioned external to the lower cowling 28. The remaining portions of the clamp 64 are positioned internal to the lower cowling 28.

The damper plate 66 of the latching mechanism 60 which is position at the rear of the motor 20 preferably has three damping members 68 extending downwardly from an inwardly extending lower portion thereof. Mating damping members 92 extend upwardly from the lower cowling 28 for abutting against the damping members 68 positioned on the damper plate 66.

The damper plate 66 of the latching mechanism 68 which is positioned at the front of the motor 20 has at least one damping member 68 extending downwardly therefrom. A mating damping member 92 extends upwardly from the lower cowling 28 for abutting against this damping member 68 on the damper plate 66.

The damping members 68,92 may comprises rubber elements or other resilient and durable members. The hook 62 and clamp 64 are preferably constructed of durable weather-resistant materials such as steel, aluminum or the like.

Referring to FIGS. 5(*a*) and (*b*), the clamp 64 of the latching mechanism 60 is moveable between a first position in which the hook-engaging member 72 engages the hook 62, and a second position in which the hook-engaging member 72 does not engage the hook 62. In the first position, the clamp 64 securely engages the hook 62 and the upper and lower cowlings 26,28 are securely connected. In the second position, the clamp 64 does not engage the hook 62 and the upper cowling 26 may be removed from the lower cowling 28.

FIG. 5(*a*) illustrates the clamp 64 in a "latched" positioned in which it engages the hook 62. As illustrated, the hook-engaging member 72 has a hook-engaging surface which is not planar. When the clamp 64 is rotated into engagement with the hook 62, the hook 62 rides along a bottom surface of the hook-engaging member 74. This bottom surface slopes downwardly, so that as the clamp 64 rotates, the hook 62 is pulled downwardly. Because the hook 62 is pulled downwardly, the upper cowling 26 is pulled downwardly with respect to the lower cowling 28 and the upper and lower cowlings 26,28 are securely engaged. The damping members 68,92 engage one another to provide a resilient coupling of the upper and lower cowlings 26,28.

When the clamp 64 is in this position, the handle 78 is positioned in the recess 90 and is generally flush with the outer surface of the lower cowling 28. This provides the motor 20 with an aerodynamic profile.

What is claimed is:

1. A cowling latch for an outboard motor including an upper cowling having a lower surface and a lower cowling having an upper surface, said cowling latch comprising a first latching member connected to the upper cowling and a second latching member connected to the lower cowling, said second latching member being moveable between a first position in which said second latching member engages said first latching member and a second position in which said second latching member does not engage said first latching member, said second latching member including a first latching member engaging part movably mounted with respect to a support, said support having a base defined by said lower cowling and a cover attached to said base and cooperating therewith to define a passage, said engaging part being connected to a shaft which is rotatably supported in said passage and which rotates about an axis that is positioned below the upper surface of the lower cowling.

2. The cowling latch in accordance with claim 1, wherein said first latching member comprises a hook.

3. The cowling latch in accordance with claim 2, wherein said hook is connected to a plate connected to an inside surface of said upper cowling.

4. The cowling latch in accordance with claim 1, including an engine positioned in an engine compartment defined by said upper and lower cowlings, said engine having at least one spark plug, all of said spark plugs positioned vertically higher than said support.

5. The cowling latch in accordance with claim 1, wherein said outboard motor has a front end and a rear end, and said first latching member and said second latching member are positioned at said rear end.

6. The cowling latch in accordance with claim 1, wherein said shaft has a first end and a second end, said first latching member engaging part connected to said first end of said shaft and a handle connected to said second end of said shaft.

7. The cowling latch in accordance with claim 7, wherein said lower cowling has a recessed area in which said handle is positioned.

8. An outboard motor comprising an upper cowling having a lower edge, a lower cowling having an upper edge, and a latching mechanism operating between the upper and lower cowlings to couple selectively said upper cowling to said lower cowling, said latching mechanism including a first latching member connected to said upper cowling and a second latching member connected to said lower cowling, said second latching member rotatable between a first position, in which said second latching member engages said first latching member to secure said upper cowling to said lower cowling, and a second position, in which said second latching member does not engage said first latching member, said second latching member including a shaft rotating about an axis that is positioned below said upper edge of said lower cowling, and a support having a base defined by said lower cowling and a cover attached to said base and cooperating therewith to define a passage, said shaft extending through said passage.

9. The outboard motor in accordance with claim 8, wherein said first latching member comprises a hook.

10. The outboard motor in accordance with claim 9, wherein said second latching member comprises a hook-engaging part extending from a first end of said shaft and a user-engaging handle extending from a second end of said shaft, and said shaft being mounted to said lower cowling for rotation about said axis.

11. The outboard motor in accordance with claim 8, including an engine, said engine having at least one spark plug, said at least one spark plug positioned above said axis.

12. A cowling latch for an outboard motor including an upper cowling having a lower surface and a lower cowling having an upper surface, said cowling latch comprising a first latching member connected to the upper cowling, a second latching member connected to the lower cowling, said second latching member being moveable between a first position, in which said second latching member engages said first latching member to connect the upper cowling to the lower cowling, and a second position, in which said second latching member does not engage said first latching member, said second latching member including a first latching member engaging part movably mounted with respect to a support, said support being positioned below the upper surface of the lower cowling, and at least one upper damping member extending from the upper cowling and at least one lower damping member extending from the lower cowling, said upper and lower damping members engaging one another at least when the upper cowling is connected to the lower cowling.

13. The cowling latch in accordance with claim 12, wherein said support has a base defined by said lower cowling and a cover attached to said base and cooperating therewith to define a passage, and said engaging part is connected to a shaft which is journaled in said passage.

14. The cowling latch in accordance with claim 13, wherein the lower damping member is deposed above the cover.

15. The cowling latch in accordance with claim 12, additionally comprising at least another upper damping member extending from the upper cowling and at least another lower damping member extending from the lower cowling, said another upper and lower damping members engaging one another at least when the upper cowling is connected to the lower cowling, and said first latching member being disposed generally between said upper damping members.

16. The cowling latch in accordance with claim 12, wherein said upper damping member extends downwardly and said lower damping member extends upwardly, and both of said upper damping member and said lower damping member abut against each other.

17. The cowling latch in accordance with claim 12, wherein both of said upper damping member and said lower damping member are made of an elastic material.

18. The cowling latch in accordance with claim 12 in combination with an outboard motor having a front end and a rear end, wherein each of said front end and said rear end has at least one pair of said upper and lower damping members.

19. The combination of claim 18, wherein the number of pairs of said upper and lower damping members at said front end of the outboard motor is different from the number of pairs of said upper and lower damping members at said rear end of said outboard motor.

20. The combination of claim 19, wherein the number of pairs of said upper and lower damping members at said front end of the outboard motor is lesser than the number of pairs of said upper and lower damping members at said rear end of said outboard motor.

21. An outboard motor comprising an engine including at least one spark plug, an upper cowling having a lower edge, a lower cowling having an upper edge extending along at least a curved section of said lower cowling, said engine being arranged on said lower cowling such that a lowermost one of said at least one spark plug lies above said upper edge of said lower cowling, and a latching mechanism operating between said upper and lower cowlings to couple selectively said upper cowling to said lower cowling, said latching mechanism including a first latching member being connected to said upper cowling and a second latching member being connected to and disposed along said curved section of said lower cowling, said second latching member rotatable between a first position, in which said second latching member engages said first latching member to secure said upper cowling to said lower cowling, and a second position, in which said second latching member does not engage said first latching member, said second latching member including a shaft rotating about an axis that is positioned below said upper edge of said lower cowling and that lies generally parallel to a tangent at a center point of said latching mechanism along said curved section of said lower cowling.

* * * * *